US006138880A

United States Patent [19]

Williams

[11] Patent Number: 6,138,880

[45] Date of Patent: Oct. 31, 2000

[54] CLIP FOR A WIRE CLOTHES HANGER

[76] Inventor: Gene Emmons Williams, 20 Galli Dr. #15, Novato, Calif. 94949

[21] Appl. No.: 09/309,760

[22] Filed: May 11, 1999

[51] Int. Cl.[7] ..... A47G 25/28

[52] U.S. Cl. ..... 223/98

[58] Field of Search ..... 223/98, 85, 84, 223/88, 92

[56] References Cited

U.S. PATENT DOCUMENTS

| | | | |
|---|---|---|---|
| 3,602,408 | 8/1971 | Gaydos | 223/98 |
| 3,680,748 | 8/1972 | Brunhuber | 223/98 |
| 3,866,810 | 2/1975 | Florian | 223/98 |
| 4,632,287 | 12/1986 | Bevelander | 223/98 |
| 5,056,694 | 10/1991 | Michalik | 223/98 |

*Primary Examiner*—Bibhu Mohanty

[57] ABSTRACT

An apparatus for use with a wire clothes hanger includes a plastic body having generally a first and a second U-shaped channel disposed on generally opposite ends of the inside of the apparatus. The apparatus forms a plastic clip that can be inserted over each of the two outside corners (arcuate ends) of the wire clothes hanger. The U-shaped channels secure the wire hanger therein by means of friction. If desired, any number of protrusions may be placed in the U-shaped channels to better retain the clip to the hanger. The clip includes a top surface that is wider than the metal wire used to form the wire clothes hanger and includes any of various ways to help retain a garment, such as a shirt or jacket thereto. Grooves, a sandpaper-like finish, and a checkering pattern are some of the ways that are applied to the top of the clip to help retain the garment in position. The clip includes an extended portion that extends beyond the arcuate ends of the hanger thereby effectively lengthening it, preferably by at least one-quarter of one inch on each side, or a preferred minimum of one-half of one inch total increase in the overall width of the hanger.

1 Claim, 3 Drawing Sheets

CLIP FOR A WIRE CLOTHES HANGER

BACKGROUND OF THE INVENTION

1. Field of the Invention

The present invention, in general relates to clothes hangers and, more particularly, to accessory clips for wire types of clothes hangers.

Wire clothes hangers are well known and in abundant use. They are the least expensive type of clothes hanger and are therefore plentiful.

A long known problem associated with their use is that they are narrow (the width is equal to the diameter of the wire) and as such they tend to crease the shoulder area of shirts and jackets that are hung from them.

Previous prior art devices have included clips that attach to wire hangers and which widen the area around their ends. Unfortunately, the nature of wire hangers is that they do not well support the garment generally because they are thin and smooth metal devices. As such, the garments tend to slide off of the hangers.

Therefore, the garment on the hanger having a prior art type of a clip attached may nevertheless shift position simply because there is nothing that tends to keep the garment in position. Even though a prior art type of slip may widen the support area it may not end up supporting the garment where desired, namely at a location proximate the shoulders.

There is another problem involving the support provided to a garment by a wire clothes hanger. The span from one end of the hanger to the opposite end is too narrow a distance to support most shirts and jackets properly at the shoulder areas.

As a result, wire hangers tend to support the garments intermediate the shoulder and neck areas. This is most undesirable because it tends to impress a crease mark in this area. If a support mark were formed at the shoulder area, it would be less visible than where present wire clothes hangers leave an impression. Still, it is preferable to support the garment properly all the way to the shoulder area and in such a way that a support mark is not formed or impressed into the garment.

Also, prior known types of wire clothes hanger clips have tended to be either flimsily constructed or made of impermanent materials, such as Styrofoam. Not only do such materials when used, deter public acceptance and usage of these types of devices but Styrofoam, in particular, can degrade and by way of static electricity produce unsightly particles that cling to the clothes.

Accordingly, there exists today a need for a clip for wire clothes hangers that is durable, does not produce debris that can cling to the clothes, supports the garment proximate the shoulder area, does not crease the garment, and which resists unwanted motion of the garment while it is suspended by the hanger.

Clearly, such an apparatus would be a useful and desirable device.

2. Description of Prior Art

Clips for clothes hangers are, in general, known. For example, the following patents describe various types of these devices:

U.S. Pat. No. 2,398,873 to Ward, Apr. 23, 1946;

U.S. Pat. No. 2,448,726 to Nelson, Sep. 7, 1948;

U.S. Pat. No. 3,484,029 to Gaydos, Dec. 16, 1969; and

U.S. Pat. No. 4,529,110 to Tate, Jul. 16, 1985.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a clip for a wire clothes hanger that is easy to manufacture.

It is also an important object of the invention to provide a clip for a wire clothes hanger that is inexpensive to manufacture.

Another object of the invention is to provide a clip for a wire clothes hanger that is durable.

Still another object of the invention is to provide a clip for a wire clothes hanger that helps to retain a garment in proper position when it is suspended on the hanger.

Still yet another object of the invention is to provide a clip for a wire clothes hanger that is made of plastic.

Yet another important object of the invention is to provide a clip for a wire clothes hanger that includes grooves on top.

Still yet another important object of the invention is to provide a clip for a wire clothes hanger that includes checkering on top.

One further important object of the invention is to provide a clip for a wire clothes hanger that effectively lengthens the hanger.

One yet further important object of the invention is to provide a clip for a wire clothes hanger that does not crease a garment placed thereon.

Briefly, an apparatus for use with a wire clothee hanger that is constructed in accordance with the principles of the present invention includes a clip that is adapted for insertion onto a wire clothes hanger at each opposite end thereof. The clip includes a top portion that is wider than the diameter of the metal used to form the wire clothes hanger. The clip is made of a durable material, such as plastic, and includes a pattern impressed or molded into the top that resists motion of a garment, such as a shirt or jacket that may be placed thereon. The clip includes a pair of channels adapted for attachment to the wire hanger and includes an extended portion that extends beyond the end of the wire clothes hanger a predetermined distance, thereby effectively increasing the overall length of the hanger.

DETAILED DESCRIPTION OF THE INVENTION

Figure 1:
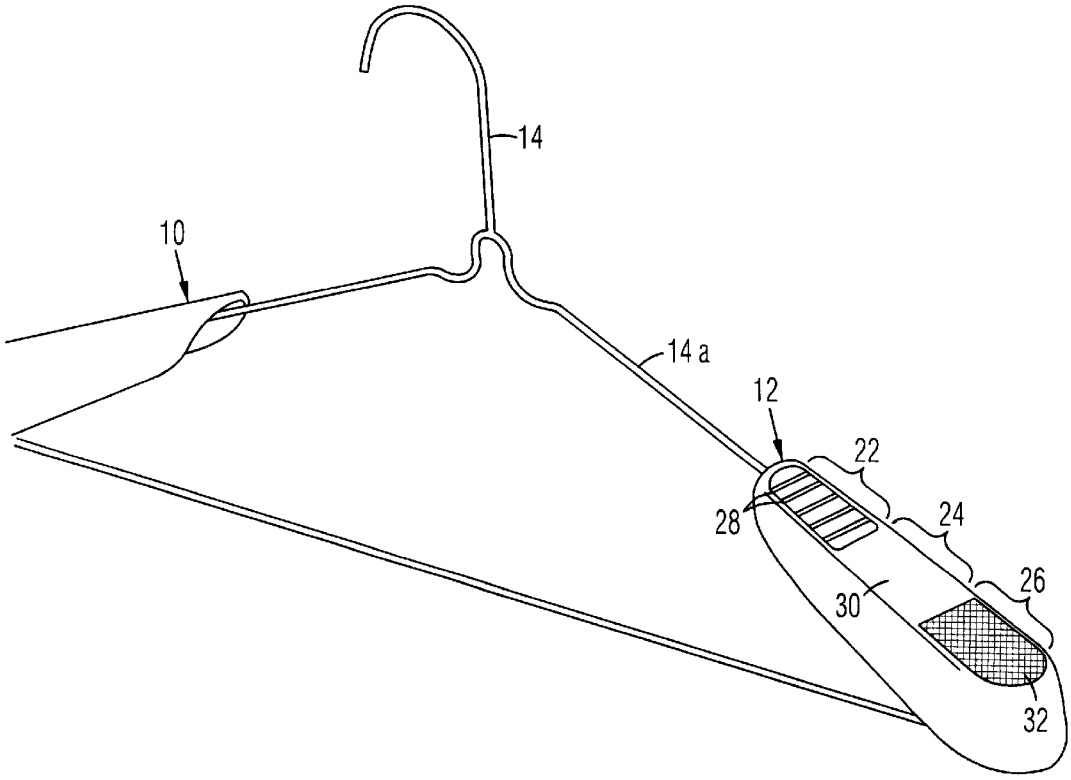
FIG. 1 is a view in perspective of a pair of the inventive clips attached to a wire clothes hanger.
Figure 2:
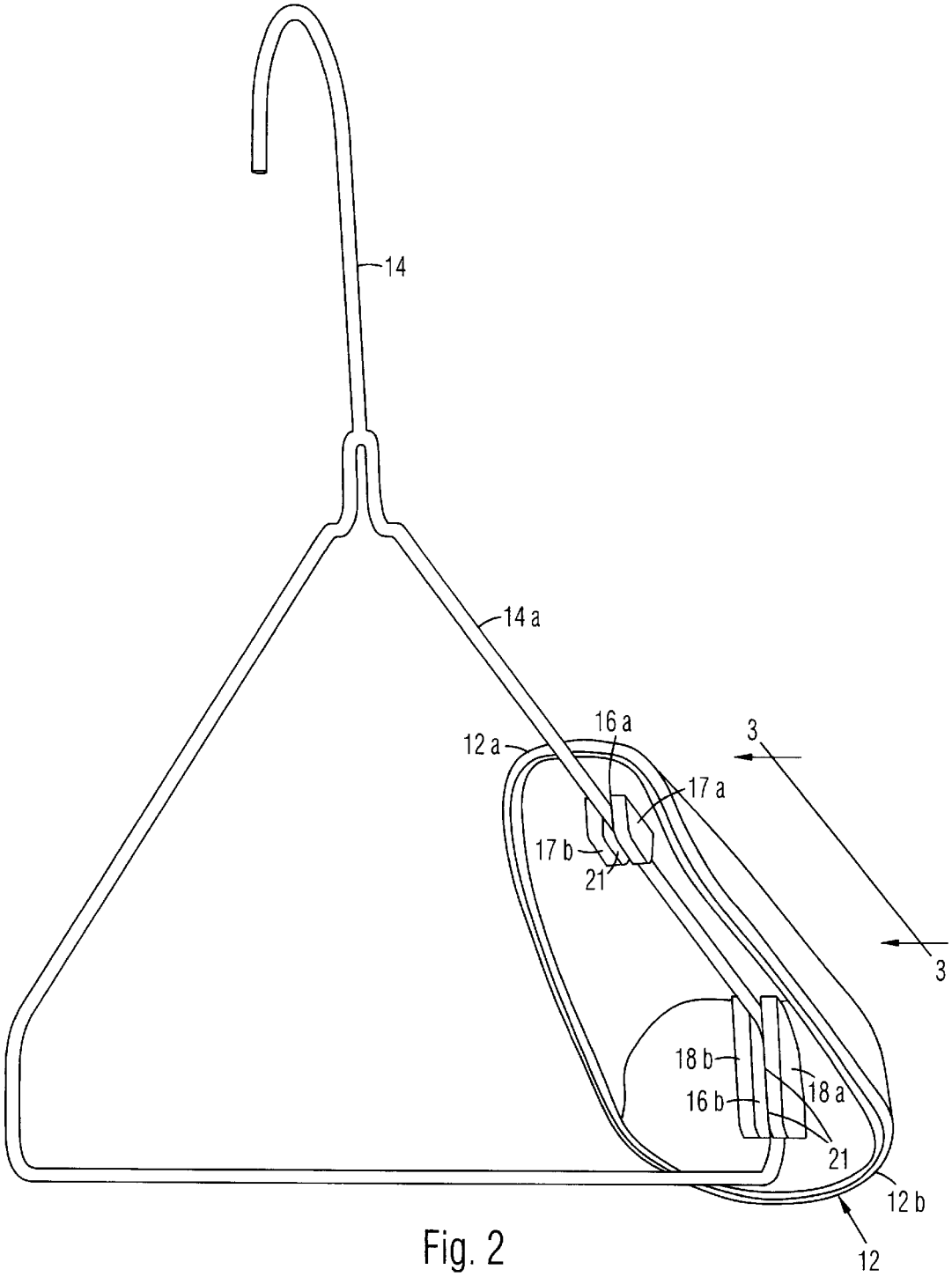
FIG. 2 is a view in perspective taken from underneath the clip showing attachment to the hanger.
Figure 3:
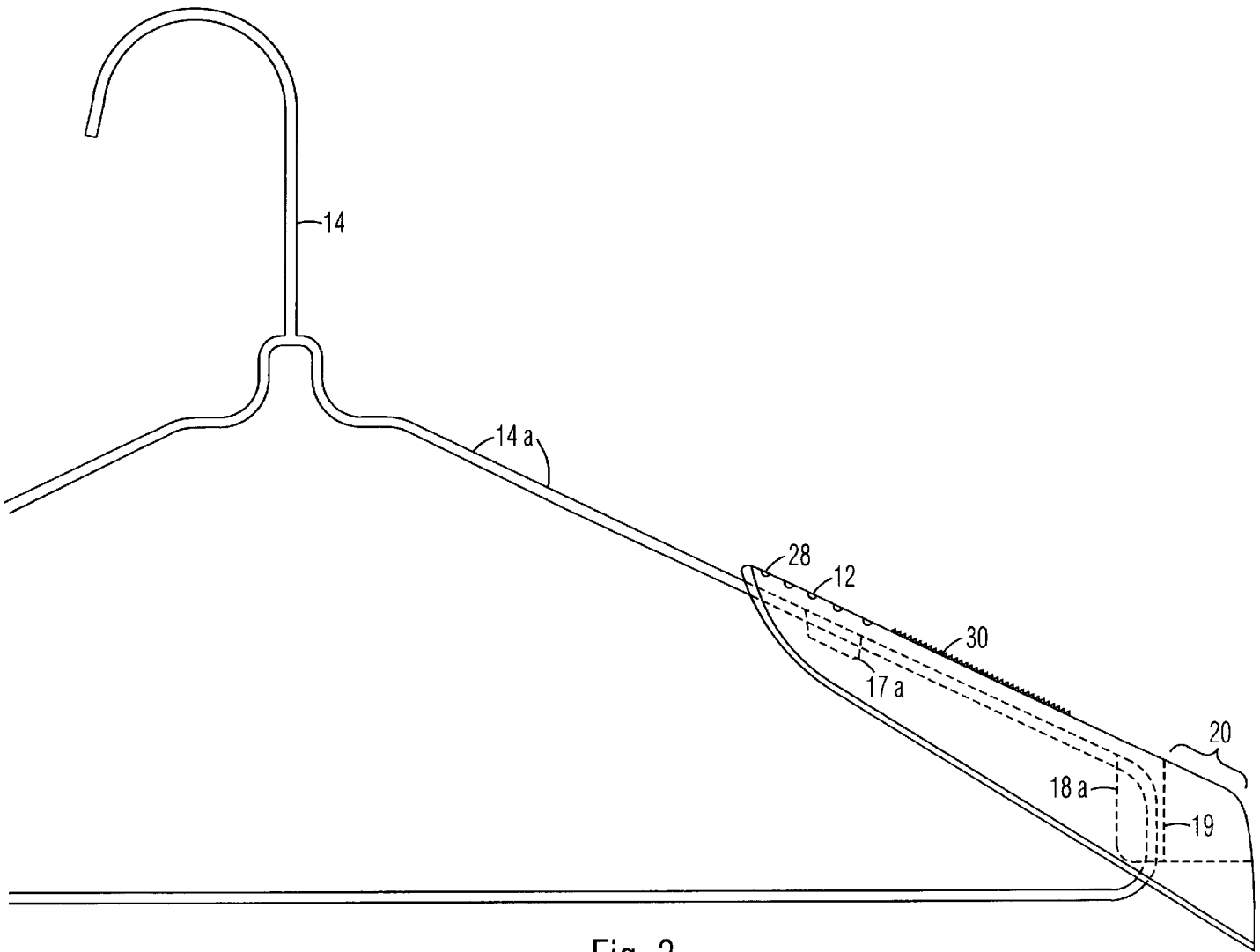
FIG. 3 is a cross sectional view taken on the line 3—3 in FIG. 2.

Referring to FIGS. 1, 2, and 3 is shown, a first clip for a wire clothes hanger, identified in general by the reference numeral 10 and a second clip for a wire clothes hanger, identified in general by the reference numeral 12.

Both the first clip 10 and the second clip 12 are identical and therefore anything that is described for the one applies also to the other.

The clips 10, 12 are each shown attached to opposite sides (or corners) of a wire clothes hanger 14. The manner in which each of the clips 10, 12 are attached to the hanger 14 is described in greater detail hereinafter.

The clips 10, 12 each include a first substantially U-shaped channel 16*a* that runs along a portion of the longitudinal length on the inside surface thereof. The first U-shaped channel 16*a* is disposed near a first end 12*a* of the clip 12 and it is formed intermediate a first pair of members 17*a*, 17*b* that extend from the inside of the clip a predetermined distance and which are disposed in a spaced apart parallel planar orientation with respect to each other and generally perpendicular with respect to a top area of the clip 10, 12.

The spacing that is provided intermediate the first pair of members 17*a*, 17*b* form the first U-shaped channel 16*a*. The pair of members 17*a*, 17*b* are spaced apart a distance that approximates the diameter of the wire used to form the hanger 14. Ideally, the spacing is slightly less than the diameter of the wire so as to better secure the clip 10, 12 to the hanger 14 by creating a friction fit between the wire of the hanger 14 and the first pair of members 17*a*, 17*b*.

The clips 10, 12 each include a second substantially U-shaped channel 16*b* on the inside surface thereof proximate a second end 12*b* that is opposite the first end 12*a*. The second U-shaped channel 16*b* is formed intermediate a second pair of members 18*a*, 18*b*. The second pair of members 18*a*, 18*b* extend from the inside of the clip a predetermined distance and are disposed in a spaced apart parallel planar orientation with respect to each other. They are also generally parallel with respect to the first pair of members 17*a*, 17*b*. The second pair of members 18*a*, 18*b* extend from the second end 12*b* of the clip 10, 12 a predetermined distance toward the first end 12*a*.

The second U-shaped channel 16*b* is adapted to receive an arcuate end of the wire hanger 14 therein in a manner similar to that by which the first U-shaped channel 16*a* receives and secures a portion of the hanger 14.

The second U-shaped channel 16*b* includes a limit stop 19 (See FIG. 3) that prevents the arcuate end of the hanger 14 from entering therein beyond a certain point, as defined by the limit stop 19.

The clip 10, 12 includes an extended portion, identified in general by the reference numeral 20, that extends past the arcuate end of the hanger 14. The extended portion 20 effectively lengthens each side of the hanger 14 so that the overall gain in the length of the hanger 14 is equal to two times the length of the extended portion 20 (one on each side).

The increased length permits the clip 10, 12 to provide support for a garment (not shown) such as a shirt or jacket proximate the shoulder area, where such support is desired, rather than at a location intermediate the shoulder and the neck of the garment.

A plurality of protrusions 21 that extend further into the first and second U-shaped channels 16*a*, 16*b* may also be added as desired and disposed in the channels 16*a*, 16*b*. When the protrusions 21 are used, friction between the hanger and clip 10, 12 is increased to whatever extent is desired.

To install each of the clips 10, 12, they are placed on the outside of the hanger 14 so that the wire corners of the hanger align with the channels 16*a*, 16*b* at both the top (first end 12*a*) and second end 12*b* portions of the clip 10, 12 simultaneously. Then the clip 10, 12 is forced into the hanger 14 by exerting a force to the clip 10, 12 in a direction that is generally toward the opposite corner of the hanger 14.

As mentioned above, friction holds the clip 10, 12 in place. If the protrusions 21 are used, then the clip 10, 12 will tend to "snap" in place as it is inserted when the wire of the hanger 14 passes over the protrusions 21.

Together, the first and second U-shaped channels 16*a*, 16*b* also serve to secure the clip 10, 12 in such a manner as to prevent it from rotating about the hanger 14. This is because the first channel 16*a* secures the clip 10, 12 to a top member 14*a* of the hanger 14.

The clip 10, 12 would be able to rotate about a longitudinal axis of the top member 14a where it not for the second channel 16*b* which secures the clip 10, 12 a predetermined distance away from the longitudinal axis of the top member 14*a*, thereby preventing the clip 10, 12 from rotating around the top member 14*a*.

Similarly, the first channel 16*a* stops any tendency the clip 10, 12 might have from rotating around the arcuata portion of the hanger 14.

Referring now in particular to the second clip 12, the top area is divided into three zones, identified by the three reference numerals 22, 24, and 26 for zones one to three, respectively. Again, although discussion centers around the second clip 12, it being identical to the first clip 10, the following discussion will also apply to the first clip 10.

Zone one 22 includes a plurality of grooves 28 that are formed across the top so as to be perpendicular with a longitudinal length of the hanger 14 when affixed to the clip 12. The grooves 28 can either be impressed or cut into the clip 12 after it has been formed or they can be molded in place when the clip 12 is actually being formed.

The purpose of the grooves 28 is to resist motion of the garment that is placed on the hanger 14. The garment, as was previously mentioned, would typically be a shirt, a jacket, or the like.

Zone two 24 includes a sandpaper texture 30 that is formed across the top. The sandpaper texture 30 can either be impressed or cut into the clip 12 after it is formed or it can be molded in place when the clip 12 is actually being formed.

The purpose of the sandpaper texture 30 is also to resist motion of the garment that is placed on the hanger 14.

Zone three 26 includes a checkering pattern 32 that is formed across the top. The checkering pattern 32 can either be impressed or cut into the clip 12 after it is formed or it can be molded in place when the clip 12 is actually being formed.

The purpose of the checkering pattern 32 is once again to resist motion of a garment that is placed on the hanger 14.

If desired, any of the zones (one to three) 22, 24, 26 can be varied as desired to include as much or as little of the top of the clip 12, as desired, or certain of the zones 22, 24, 26 can even be eliminated. For example, the entire top could be formed of the grooves 28 or, alternatively, it could be formed entirely of the sandpaper texture 30 or, alternatively, it could be formed entirely of the checkering pattern 32 or any combination or proportion of the above.

The first and second clips 10, 12 are formed of a durable material such as plastic or the like. It is desirable that they be durable to please the public, but it is also necessary that they be formed of a material that can retain for an extended period of time the grooves 28, the sandpaper texture 30, or the checkering pattern 32. Certain materials, such as Styrofoam, can not adequately retain these types of surface features that are intended to prevent slippage of the garment from occurring.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A clip for a wire clothes hanger to increase the overall width of the clothes hanger, comprising:

a plastic body that includes a substantially planar top portion that is wider than the diameter of the wire of said hanger; the length of said body being about half the length of a coat hanger arm or less;

said body including means for attaching said clip to said hanger including a first pair of members spaced apart about the width of the wire forming a channel, and a second pair of members spaced about the width of the wire forming a channel, the channels being aligned to form a receptacle for securing the plastic body to the wire hanger;

and friction means for retaining a garment disposed on said top portion.

* * * * *